United States Patent [19]

Hickerson

[11] Patent Number: 5,027,954

[45] Date of Patent: Jul. 2, 1991

[54] CHILD PROOF CONTAINER AND SAFETY CLOSURE

[76] Inventor: Frederick R. Hickerson, R.D. 6 Box 530, Newton, N.J. 07860

[21] Appl. No.: 491,533

[22] Filed: Mar. 12, 1990

[51] Int. Cl.[5] ..... B65D 50/00

[52] U.S. Cl. ..... 215/201; 215/219

[58] Field of Search ..... 215/316, 329, 330, 331, 215/332, 274, 275, 276, 277, 343, 344, 345, 354, 355, 356, 357, 201, 31, 219, 221; 220/288, 319, 320

[56] References Cited

U.S. PATENT DOCUMENTS

| | | | |
|---|---|---|---|
| 1,198,948 | 9/1916 | Newton | 215/13 |
| 1,999,622 | 4/1935 | Algeo | 215/316 |
| 3,027,034 | 3/1962 | Christian | 215/9 |
| 3,164,277 | 1/1965 | Reading | 215/9 |
| 3,308,979 | 3/1967 | Hailes | 215/9 |
| 3,403,803 | 10/1968 | Markowitz | 215/9 |
| 3,601,274 | 8/1971 | Johnson | 215/9 |
| 3,750,817 | 8/1973 | Bozek | 215/9 |
| 3,830,392 | 8/1974 | Kessler et al. | 215/201 |
| 3,850,325 | 11/1974 | MacLeod | 215/218 |
| 3,858,740 | 1/1975 | Lestaevel | 215/221 X |
| 4,002,258 | 1/1977 | Curry | 215/219 X |
| 4,337,869 | 7/1982 | Guinle | 215/201 |
| 4,690,292 | 9/1987 | Henning | 215/201 |

FOREIGN PATENT DOCUMENTS

| | | | |
|---|---|---|---|
| 429214 | 5/1935 | United Kingdom | 215/31 |

*Primary Examiner*—Stephen Marcus

*Assistant Examiner*—Paul Schwarz

[57] ABSTRACT

A child proof container and safety closure comprising a container, a cap for closing the open end of the container storing a hazardous product and a safety closure placed over the cap and threaded to the container. An extending tab on the top of the cap, extending through a hole in the center of the top of the closure, is manually held stationary during removal of the closure. An extending neck portion of the container and a peripheral wall of the cap, positioned over the extending neck portion, both have an offset axis displaced about the same distance from a central axis of the mating threads on the closure and the container. The offset axes of the container and the cap are positioned in alignment to permit closure removal when an alignment lug, on the outside of the extending neck portion of the container, is in contact with a shoulder of an annular slot on the inside of the peripheral wall of the cap. Serrations on the outside serrated surface of the cap and the inside serrated surface of the closure, are concentric with the threads on the closure and the container when the offset axes are in alignment. The serrations grip lock together when the offset axes go out of alignment, which occurs when the closure removal is attempted by holding the container in one hand and trying to remove the closure with the other hand. In order for a person to remove the safety closure, a proper procedure of holding the extending tab stationary to maintain proper positioning of the alignment lug in the annular slot, will allow unthreading and removal of the closure.

13 Claims, 9 Drawing Sheets

CHILD PROOF CONTAINER AND SAFETY CLOSURE

FIELD OF USE

This invention relates to a child proof container and safety closure assembly which prevents opening by children or other persons unfamiliar with the proper opening procedure.

BACKGROUND OF THE INVENTION

A variety of child proof safety closures have been designed and marketed which are intended to prevent young children from opening containers of medicine and other potentially dangerous products. Most of these safety closures prevent accidental opening by children in accordance with their design features, but have a common problem of being difficult for adults to open, particularly the elderly and people who are physically handicapped.

For example, many child proof container systems for aspirin and other medicines utilize arrows or other marks on the closure and container which must be aligned before the closure can be pryed off. These systems appear to work well to prevent accidental opening by children but are not considered to be adult easy, since the alignment marks are hard to see and/or feel, the closure is very tight on the container and difficult to rotate to the exact alignment point, and is also hard to pry off even after proper alignment. The push down and twist safety closure systems now on the market, are apparently good to prevent opening by children hut because of the relatively high push and twist forces needed for opening, are not considered adult easy and are a real problem for the elderly and the handicapped. The above and other child proof closure systems which by design require relatively high forces in one direction or another are difficult for adults to open.

Many safety closures utilizing flexible skirts, thumb tabs and lugs, and tricky locking systems are not successfully marketed due to their design complexity and resulting high cost to manufacture.

SUMMARY OF THE INVENTION

The main object of the present invention is to overcome the above problems and other disadvantages of child proof container and safety closure assemblies now on the market by providing a simple and inexpensive assembly which enhances safety for the child and at the same time makes it easier for the adult, including the elderly and the handicapped, to remove the closure from the container.

A further object of the present invention is to provide a safety closure which can be removed from the container with a minimal force by following a simple removal procedure.

Still another object of the present invention is to provide a safety closure consisting of a small number of molded parts which can be simply molded and assembled by current manufacturing machinery and equipment with the result that the safety closure is of relatively low cost.

Yet another object of the present invention is for a sealing surface engagement between the container and can which occurs at a location virtually free of mold parting lines, thus providing a reliable seal.

A further object of the present invention is to provide a safety closure that requires only minor modification to existing container neck designs in order to accomodate the can and the safety closure which retains it to the container, such modification having little or no effect on the production cost of containers.

More particularly, the present invention is predicated upon the concept of providing a child proof container and safety closure assembly utilizing an unique grip locking system. In this invention, a threaded closure holds an inner cap over the top of the container to seal it. To remove the closure, an extending tab on the top of the cap is held stationary by one hand while the closure is unthreaded from the container using the other hand. Attempting to remove the closure and cap in a conventional manner, holding the container in one hand and manipulating the closure and/or the extending tab on the cap with the other hand, will be unsuccessful due to the jamming action of the grip locking system.

More particularly, in a preferred embodiment, the axis of the outlet of the extending neck portion of the container is offset slightly from the central axis of its threaded portion. A cap with a similar offset, between the axis of its inside peripheral wall which fits over the container's extending neck, and the central axis of the cap's outside serrated surface, is held tight to the top lip of the neck of the container by the closure which is threaded on to the container. In this position, serrations on the inside serrated suface of the closure are lightly engaged with the serrations on the outside serrated surface of the cap, since the offset axis of both the cap and the container are held in alignment by a protruding alignment lug on the wall of the extending neck portion of the container which mates in a positioning annular slot in the rim of the cap. When threading the closure to the container, the rear shoulder of the annular slot in the cap contacts the container alignment lug keeping the offset axes aligned with one another, thus allowing the closure to rotate clockwise to the fully closed position with only a slight drag force created by the slight touching contact of serrations on the closure slipping past the serrations on the cap. When an attempt is made to remove the closure and cap in an improper manner, counterclockwise rotation of the closure without holding the extending tab of the cap stationary, the lightly contacting serrations on the cap and in the closure will cause the cap to rotate slightly on the container, with resulting grip locking as the offset axis of the cap goes out of alignment with the offset axis of the container. The length of the annular slot in the cap is sufficient to allow the needed relative movement between the cap and the container so that the alignment lug on the container does not contact the opposite shoulder of the slot. As additional force is applied when attempting to remove the closure incorrectly, the locking becomes even greater, preventing removal of the closure and cap. To remove the closure and cap once grip locking has occurred, the closure is simply retightened on the container by rotating it in a clockwise direction to realign the offset axes and allow the correct removal procedure to be followed.

One advantage of the present invention is that the removal of the safety closure when performed in the specified manner, requires an applied force approximately equal to the required force needed to open a conventional threaded closure. Thus, an adult who follows the specified procedure can readily remove the safety closure even though the adult may suffer from an afflicition which limits the force he can apply to remove the safety closure.

Another advantage of the present invention is that accidental removal of the safety closure by young children is close to impossible since children will nearly always hold the container in one hand while attempting to open it. The reason children hold containers (bottles) is because as babies they start out holding nursing bottles, when older they play with toy bottles and the like, when older still they eat and drink foods from bottles and also observe the holding of common household bottles by family members and others. The grip lock system of the invention prevents opening of the safety closure when the container is hand held.

A still further advantage of the present invention is that removal procedure for the closure and cap does not require any special visual observations and can readily be performed in the dark and by persons with impaired vision.

Another advantage of the present invention is that in addition to the container only two molded parts are required, the closure and the cap, so that the invention may be economically manufactured.

Further objects and advantages of my invention will become apparent from a consideration of the drawings and ensuing description of it.

REFERENCE NUMERALS IN DRAWING

Figure 1:
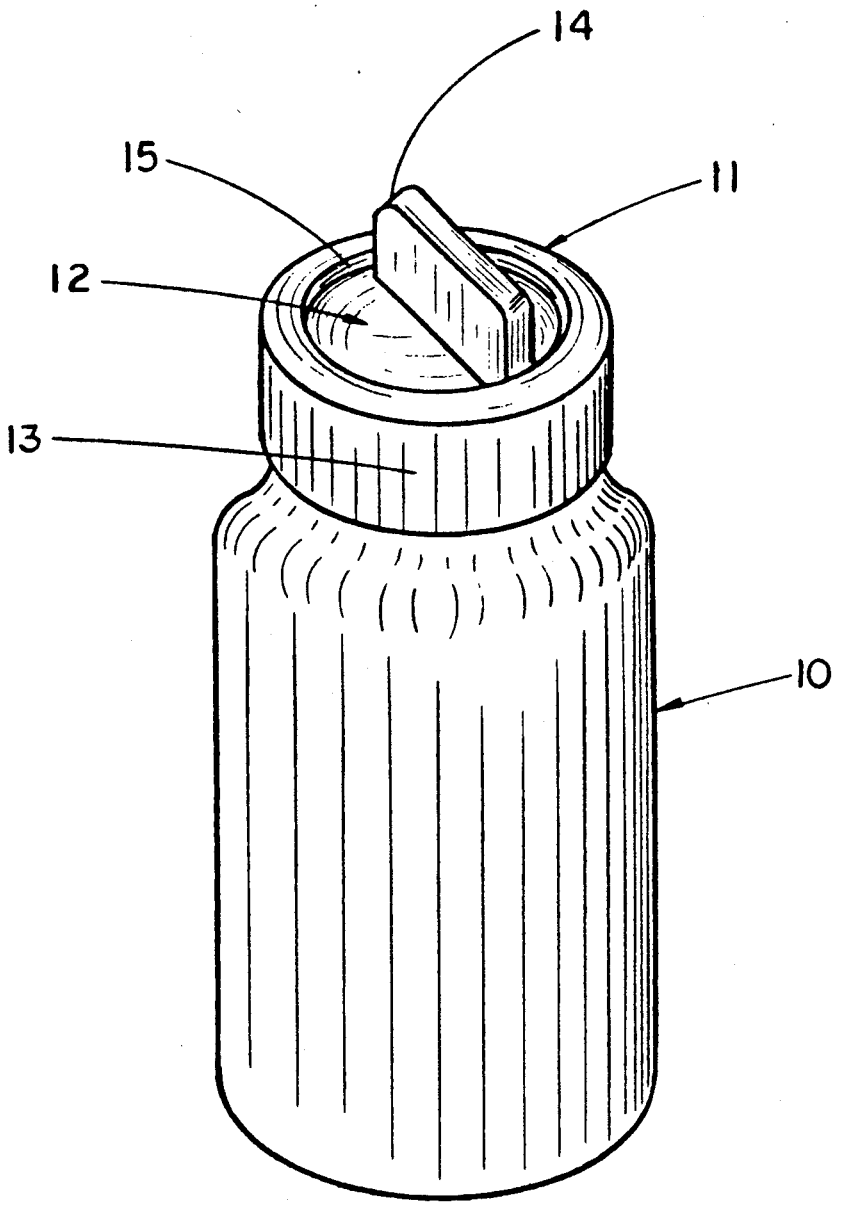
FIG. 1 is a perspective view of a child proof container and safety closure embodying the invention.

10 container
11 safety closure
12 cap
13 corrigated surface
14 extending tab
15 hole
16 neck portion
17 male thread
18 internal thread
19 peripheral wall
20 extending neck portion
21 peripheral wall
22 outside serrated surface
23 annular slot
24 protruding alignment lug
25 shoulder
26 inside serrated surface
27 lip
28 flat surface
29 shoulder
30 small tooth
31 cap
32 neck portion
33 container
34 protruding alignment lug
35 peripheral wall
36 annular slot
37 shoulder
38 outside serrated surface
39 recess
40 beads
41 sealing disc
42 coin slot
43 coin

DESCRIPTION OF THE PREFERRED EMBODIMENTS

Referring first to FIG. 1, there is illustrated a dispensing container designated by numeral 10, preferably but not necessarily in the form of a molded plastic bottle, together with a safety closure 11 and an inner cap 12. Also illustrated in FIG. 1 is a corrugated surface 13 on the outside periphery of the closure 11 for hand gripping during tightening and removal procedures. An extending tab 14 on the top of the cap 12 protrudes through a hole 15 in the top of the closure 11 and the exposed end portion of the extending tab 14 is designed to be hand held during the closure 11 removal procedure.

Figure 2:
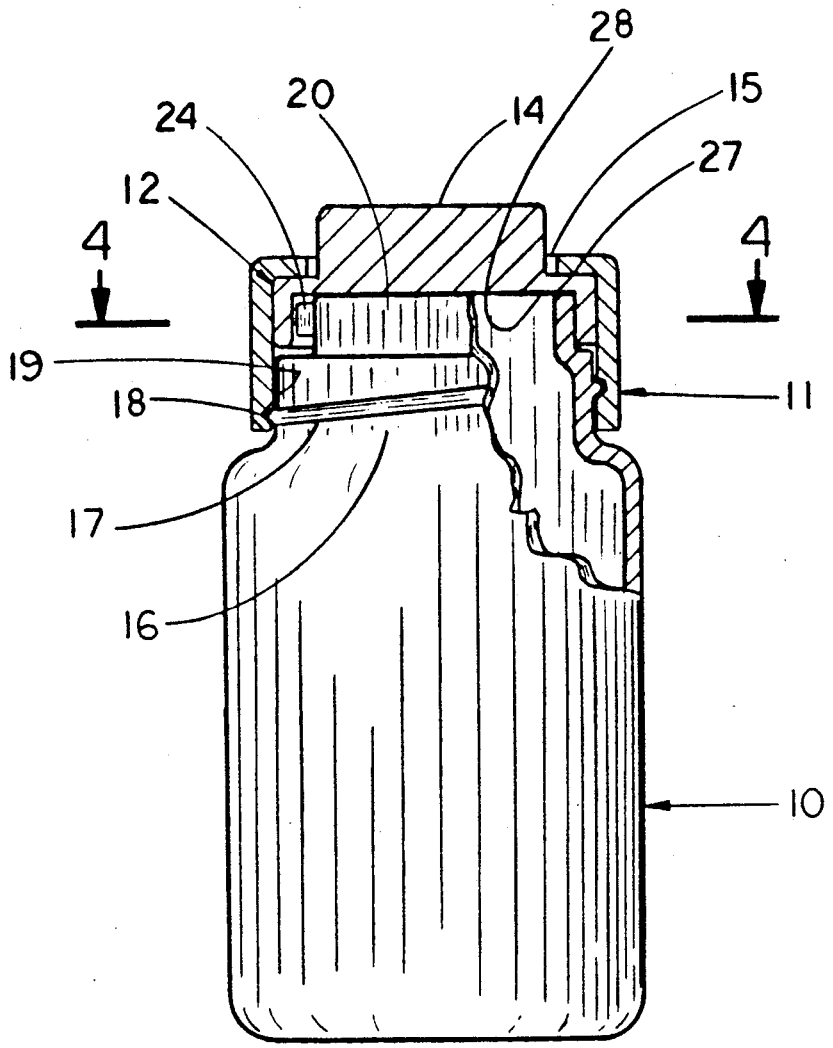
FIG. 2 is a vertical sectional view of the safety closure and cap attached to the container.
Figure 3:
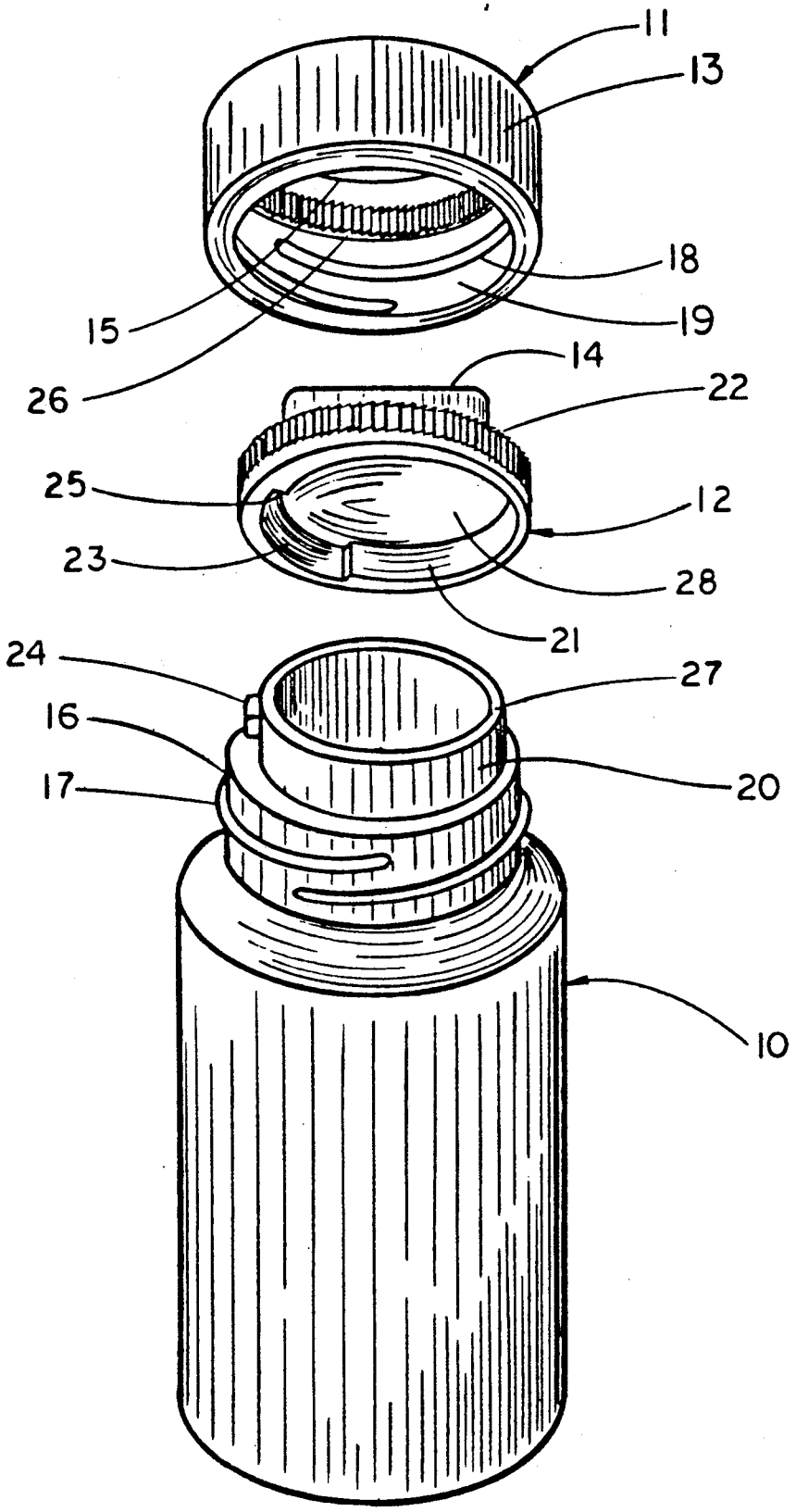
FIG. 3 is an exploded perspective illustrating the safety closure, cap and container in accordance with the present invention.

As shown in FIGS. 2 and 3, the container 10 has a centrally located circular neck portion 16 which contains a male thread 17. An internal thread 18, located inside a peripheral wall 19 of the closure 11 is in the form of a groove extending about one and one half revolutions and is contoured to freely engage the male thread 17. Container 10 further has an extending neck portion 20, located on the top end of the center neck portion 16, which is intentionally designed with its axis offset from the central axis of the male thread 17. The cap 10 is also designed to provide the same axis offset between the inside of a peripheral wall 21 and a peripheral outside serrated surface 22, as shown in FIG. 3. The peripheral wall 21 is adjacent to extending neck portion 20 of the container 10. An annular slot 23 in the peripheral wall 21, mates with a protuding alignment lug 24 on the extending neck portion 20. When the cap 12 is attached to the container 10 and rotated clockwise, the alignment lug 24 will seat against a shoulder 25 of the annular slot 23 and the offset axes, described above for the cap 12 and the container 10, will be in alignment with each other in accordance with the design of the invention. In this alignment position, the serrations of the outside serrated surface 22 will be concentric with an inside serrated surface 26 of the closure 11, and will allow the closure 11 to be placed over the cap 12 and threaded clockwise on the container 10, as the inside serrated surface 26 is designed to be concentric with the internal thread 18 of closure 11. A slight touching contact between the outside serrated surface 22 and the inside serrated surface 26, in the alignment position, is designed to create a slight contact during rotation of the closure 11 on the container 10. With the closure 11 threaded tightly to the container 10, sealing of the contents of the container 10 occurs where a lip 27 on the extending neck portion 20 seats on an inner flat surface 28 of the cap 12.

Figure 4:
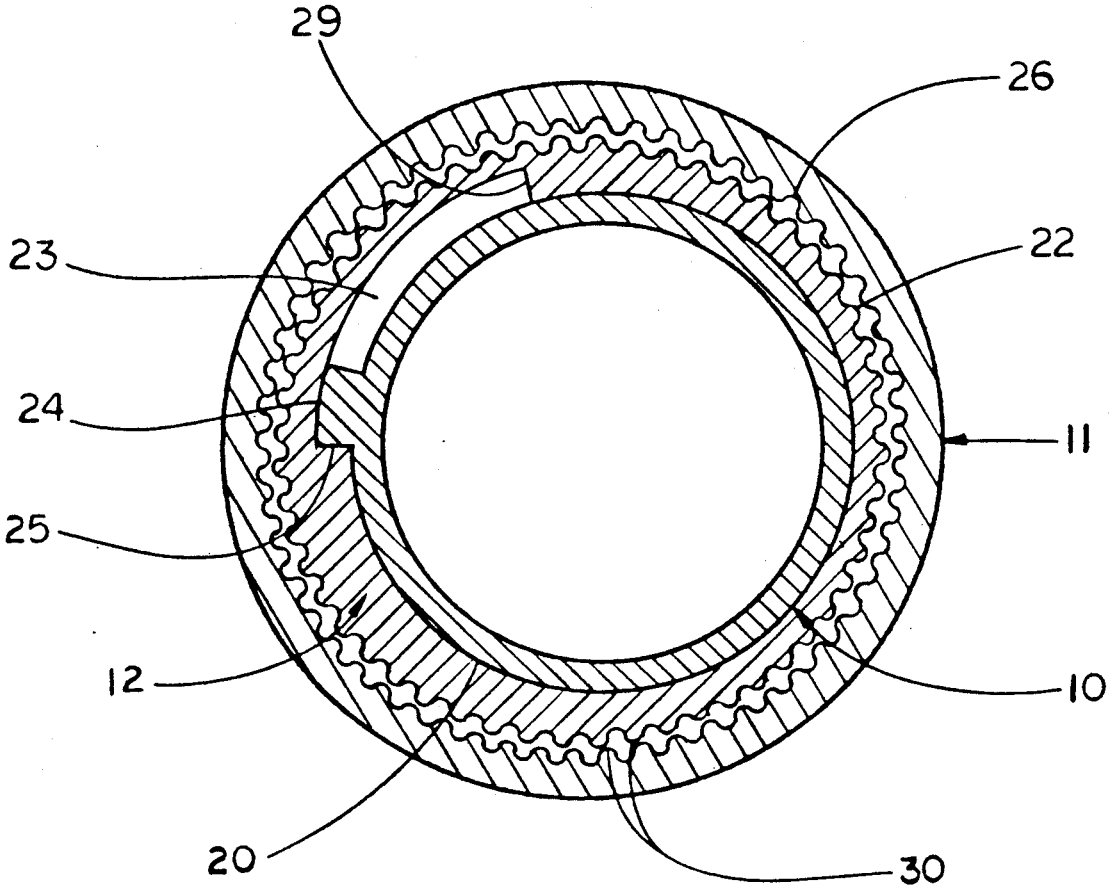
FIG. 4 is an enlarged cross sectional view taken along line 4—4 of FIG. 2 showing the aligned relationship of the safety closure, cap and container in its freely rotating or closed position.

FIG. 4. An enlarged cross sectional view taken along line 4—4 of FIG. 2, shows the concentric relationship of the closure 11, the cap 12 and the container 10 when the offset axes are at their alignment point which occurs when the alignment lug 24 is in contact with the shoulder 25 of the annular slot 23. In this position, serrations shown on the outside serrated surface 22 and the inside serrated surface 26 are concentric and lightly touch each other during rotation of the closure 11. As the closure 11 is threaded on the container 10, the cap 12 remains stationary on container 10 being held in the proper position by the alignment lug 24 being in contact with the shoulder 25. When unthreading the closure 11 from the container 10 in the proper manner, holding the extending tab 14 to prevent the alignment lug 24 from moving away from its contact with the shoulder 25, the slight contact of the serrations on the outside serrated surface 22 and the inside serrated surface 26 does not impede easy removal of the closure 11. When attempting to unthread the closure 11 from the container 10 in an improper manner, not holding the extending tab 14 of the cap 12 to maintain the alignment, the counterclockwise rotation to unthread the closure 11 will cause the cap 12 to rotate out of alignment on the container 10 into the safety or grip locking position, preventing removal of the closure 11 from the container 10. The cap 12 rotates because of the initial light contact between the serrations of the outside serrated surface 22 and the inside serrated surface 26.

Figure 5:
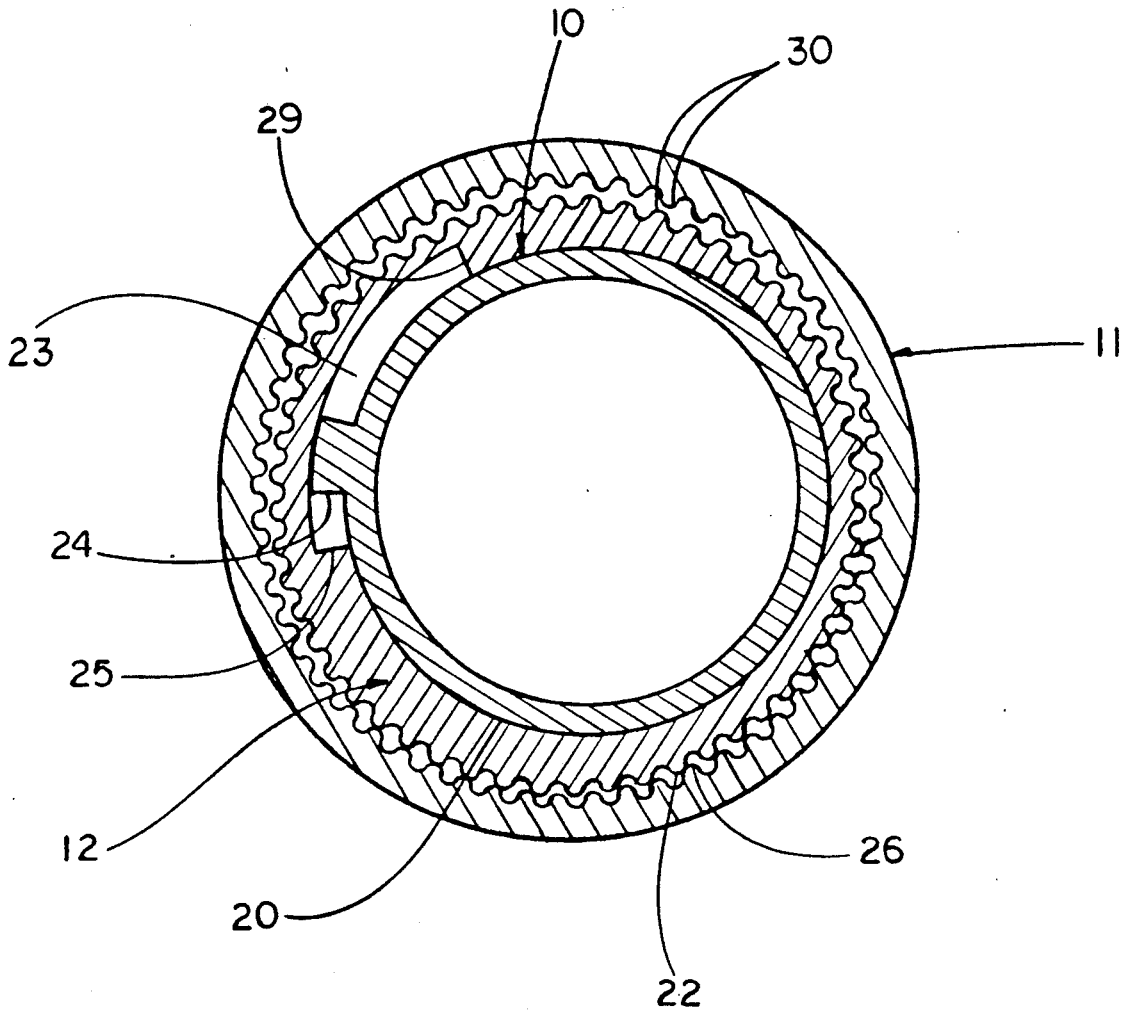
FIG. 5 is a view similar to FIG. 4 showing the relationship of these component parts in their safety grin locking position which prevents opening.

FIG. 5 shows the components in their safety or grip locking position in contrast with FIG. 4 which shows the components in their alignment position. In FIG. 5, a portion of the serrations of the outside serrated surface 22 and the inside serrated surface 26 are shown grip locked together, due to the movement of the alignment lug 24 toward a shoulder 29 of the annular slot 23 which has caused the offset axes to move off their alignment position, with the inside serrated surface 26 moving into an increasingly jamming or grip locking relationship with the outside serrated surface 22. In this grip locked position, additional force applied to unthread the closure 11 will result in increased jamming of the serrations and it will be impossible to remove the closure 11 and the cap 12 from the container 10.

The configuration of the serrations, on both the outside serrated surface 22 and the inside serrated surface 26, is shown in the enlarged cross sectional views of FIGS. 4 and 5 as a relatively small tooth 30. While the preferred serrations would he highly advantageous, most any type of gripping surface will allow the grip locking relationship.

Figure 6:
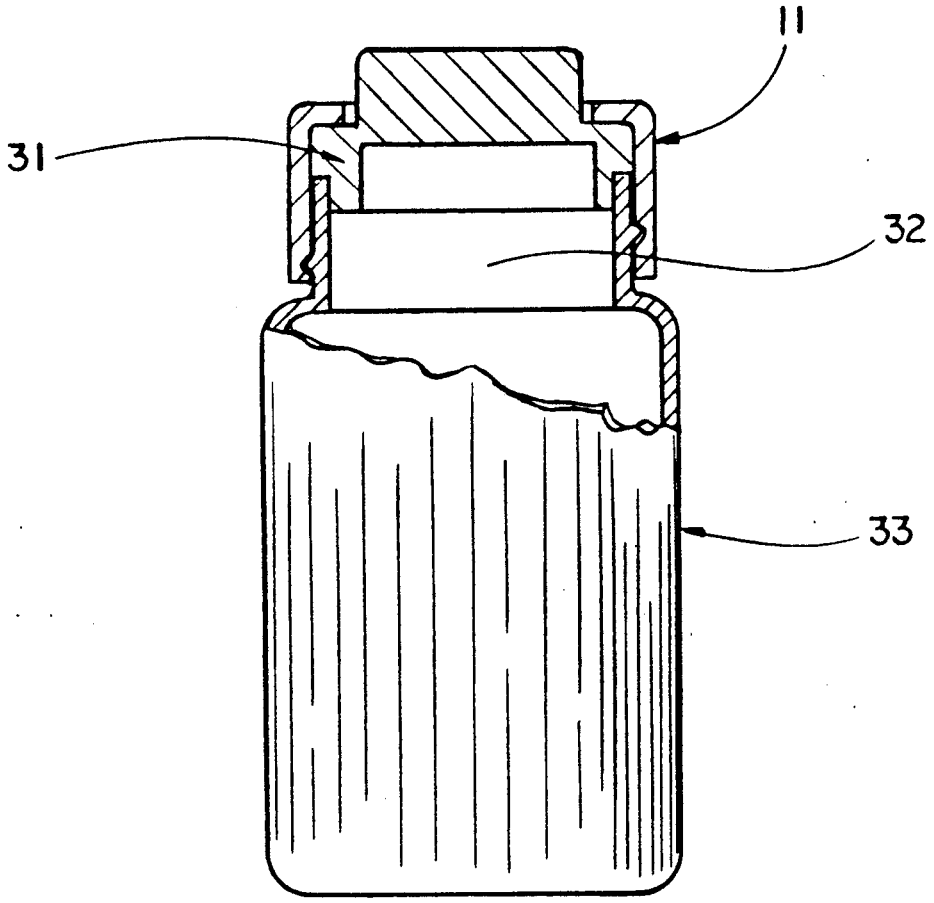
FIG. 6 is a part sectional elevational view of additional embodiments of the invention showing a safety closure retained cap which fits into the opening of the container rather than over the opening of the container as shown in FIG. 2 and FIG. 3.
Figure 7:
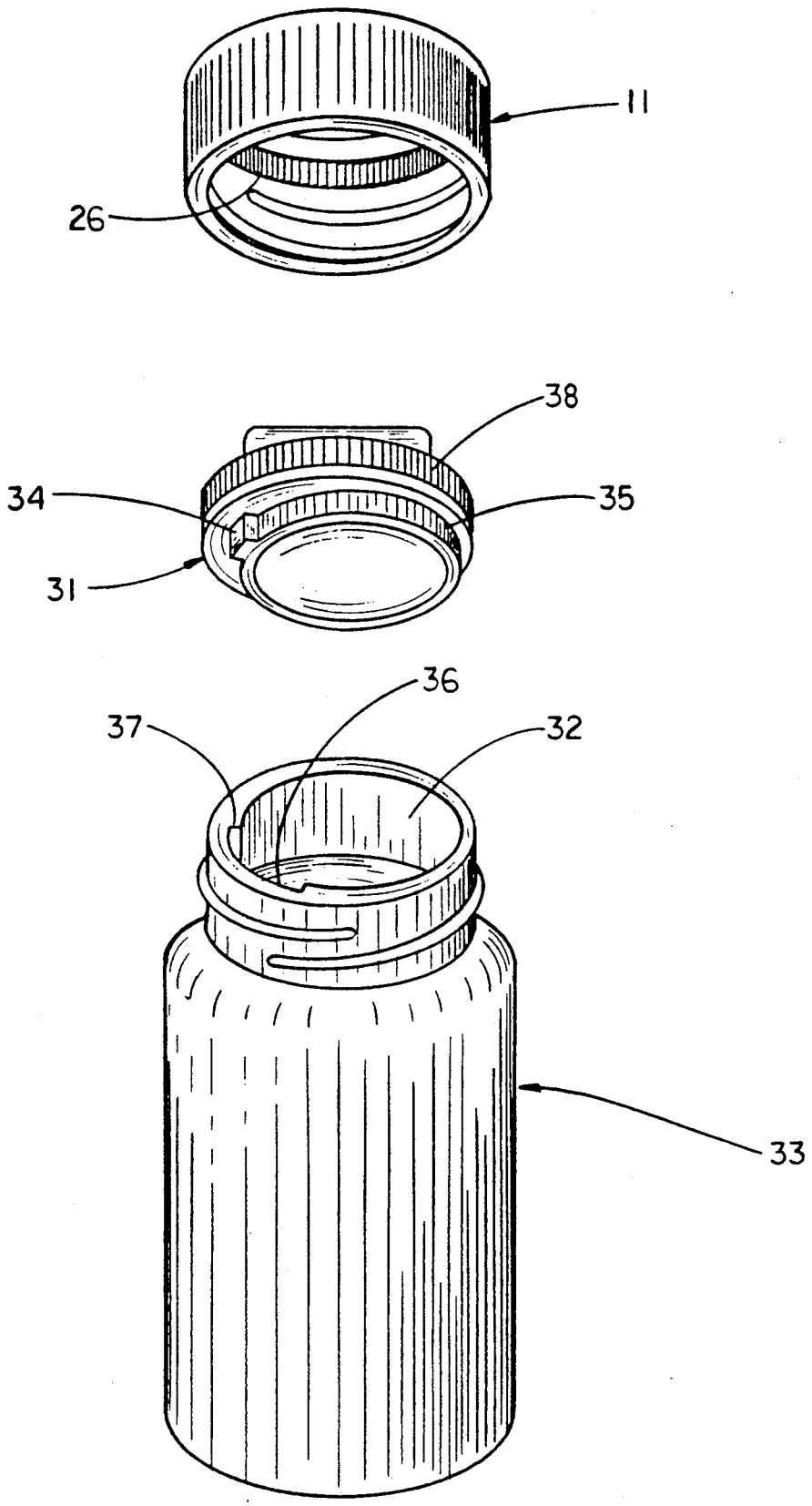
FIG. 7 is an exploded perspective further illustrating the additional embodiments shown in FIG. 6.

FIGS. 6 and 7 show a modified form of the invention where a cap 31 fits into a neck portion 32 of a container 33 instead of as in the preferred embodiment shown in FIGS. 2 and 3, where the cap 12 fits over the container 10. A protruding alignment lug 34 on the outside of a peripheral wall 35 of the cap 31 fits into an annular slot 36 on the inside of the neck portion 32, and when rotated to its alignment position, the alignment lug 34 is in contact with a shoulder 37 in the annular slot 36. In the alignment position, the safety closure 11 can be rotated on or off in the manner previously described for the preferred embodiments of the invention, as the inside serrated surface 26 of the closure 11 is concentric and slightly contacting an outside serrated surface 38 of the cap 31. Attempts to remove the closure 11 and cap 31 from the container 33 in other than the proper manner will result in the jamming and grip locking as previously described for the preferred embodiments.

Figure 8:
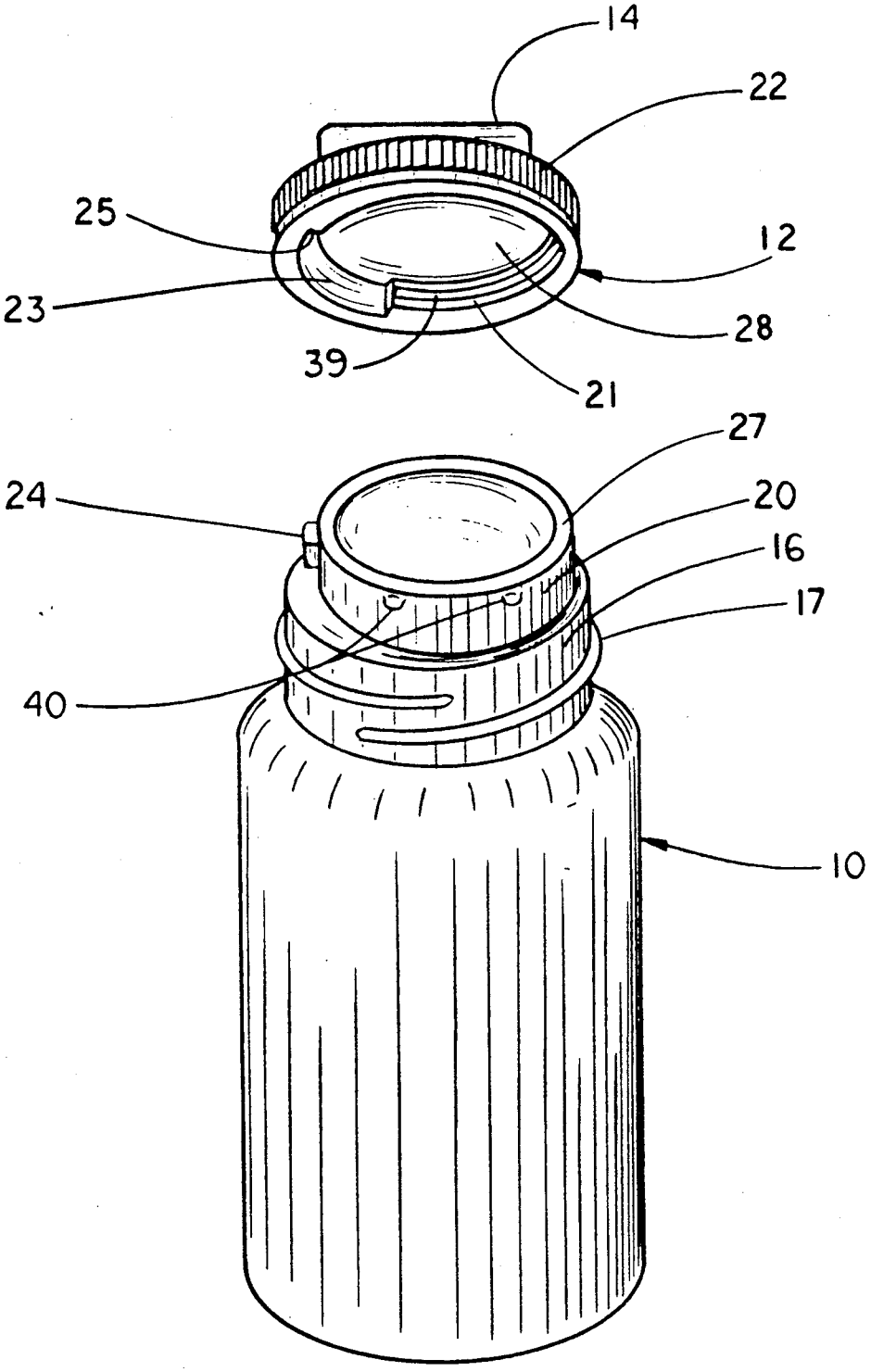
FIG. 8 is an exploded perspective illustrating an alternate embodiment of the invention showing a joining relationship for the cap and the container.

An alternate embodiment of the invention, where a securing means between the cap 12 and the container 10 allows a person to remove the safety closure 11 before removing the cap 12 from the container 10 and to replace only the cap 12 to the container 10 in situations where child proof protection is unnecessary. FIG. 8 illustrates the securing means as a continuous circumferential recess 39 on the lower inside edge of the peripheral wall 21 of the cap 12 which is adapted to accomodate a plurality of circumferentially spaced laterally projecting beads 40 on the outside of the extending neck portion 20 of the container 10. The mating relationship of the beads 40 and the recess 39, while not significantly affecting the ease of rotation of the cap 12 in the container 10, will require a light upward pull on the cap 12 of about a pound or more force to remove the cap 12 from the container 10 and a similar force to push the cap 12 back into container 10 for sealing its contents.

Figure 9:
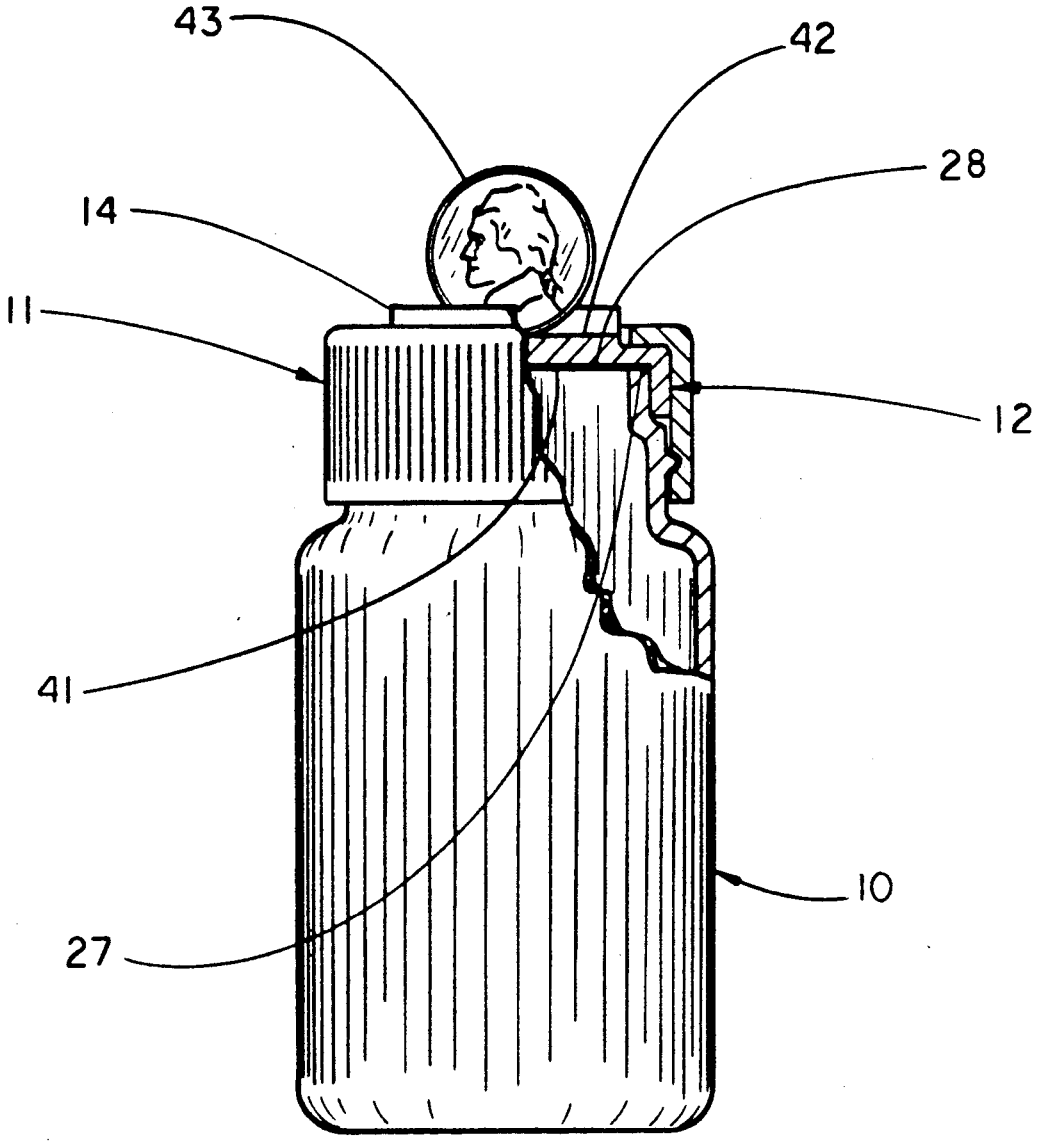
FIG. 9 is a vertical sectional view illustrating additional alternate embodiments of the invention to include a sealing disc and a coin slot.

FIG. 9 shows an additional alternate embodiment of the invention where a thin sealing disc 41 is included between the lip 27 and the inner flat surface 28. Also shown in FIG. 9 is another alternate embodiment of the invention where an exposed end portion of the extending tab 14 on the cap 12 is replaced with a coin slot 42 to require a coin 43 to be placed in the coin slot 42 and hand held stationary in order to remove the safety closure 11 in the specified manner.

Assuming that it is desired to apply the cap 12 and the safety closure 11 to the container 10, FIGS. 1–3, a person first places the cap 12 over the container 10 so that the protuding alignment lug 24 is in contact with the shoulder 25 of the annular slot 23. The closure 11 can then be threaded on to the container 10 by hand gripping the corrugated surface 13 and rotating it clockwise until the surface of the lip 27 on the container 10 and the flat surface 28 in the cap 12 contact in a sealing relationship. To remove the closure 11 and the cap 12 from the container 10 in the proper manner, one must hold the exposed end portion of the extending tab 14 on the cap 12 to prevent its rotation and merely unthread the closure 11 in a counterclockwise direction. The container 10, while not being hand held during the removal procedure, can be palmed with the same hand that is unthreading the closure 11 or placed upright on a table or other flat surface to prevent its contents from spilling. By holding the extending tab 14 stationary during closure 11 removal, the alignment lug 24 remains in contact with the shoulder 25 of the annular slot 23 maintaining the concentric alignment required to allow removal of the safety closure 11.

Assuming now the container 10, with the cap 12 and the safety closure 11 attached, which contains a harmful or dangerous medicine or other hazardous product, is in the possesion of a child, his or her efforts to remove the closure 11 will be unsuccessful despite the various manipulations that will be tried. Holding the container 10 in one hand and trying to rotate the closure 11 in a clockwise direction will only tighten the threaded closure 11 more. Should the child try to unscrew the closure 11 by rotating it in a counterclockwise direction, the closure 11 and the cap 12 will rotate slightly into a jamming or grip locking relationship. FIGS. 3–5, and the closure 11 can not be removed until it is retightened on the container 10 and the proper opening procedure followed. The above grip locking relationship occurs because the contacting serrations on the outside serrated surface 22 of the cap 12 and the inside surface 26 of the closure 11 causes the cap 12 to also rotate counterclockwise with the closure 11. As the cap 12 rotates, the shoulder 25 in annular slot 23, moves away from its contact with the alignment lug 24, causing the offset axes to go out of alignment. With the offset axis of the extending neck portion 20 of the container 10 out of alignment with the offset axis of the peripheral wall 21 of the cap 12, the outside serrated surface 22 jams or grip locks with the inside serrated surface 26, FIG. 5.

As long as the child holds the container 10 in one hand and tries to manipulate the safety closure 11 and/or the extending tab 14 of the cap 12 in one direction or another, the closure 11 can not be removed. Since children are raised holding baby bottles and other containers of one type or another, there is virtually no chance that the child will hold the closure 11 in one hand and the extending tab 14 in the other hand and perform the proper closure removal procedure. Nearly all adults will also be baffled in their attempts to remove the safety closure 11 until the proper removal procedure is revealed to them. This removal procedure is truly adult easy, as the required force to remove the closure 11 is approximately equal to the force normally required to unthread closures from comparable regular non-childproof container assemblies. The procedure is also extremely simple and can be accomplished quickly even in the dark.

The present invention will be economical to manufacture since there are only two relatively simple molded plastic parts in addition to the container 10 which can be made from plastic, glass or metal. These parts may be manufactured and assembled using current manufacturing methods, machinery and equipment.

Although the description above contains many specifics, these should not be construed as limiting the scope of the invention but as merely providing illustrations of some presently preferred emobodiments of this invention.

Thus the scope of the invention should be determined by the appended claims and their legal equivalents, rather than by the examples given.

I claim:

1. A child proof container and safety closure comprising:

(a) a container for storing a hazardous product including a safety closure engagement means for attaching a safety closure to said container wherein said closure engagement means defines a central axis, and an extending neck portion having an offset axis displaced a given distance from said central axis;

(b) a cap for sealing said container including a peripheral wall having an offset axis displaced said given distance from said central axis;

(c) a safety closure placed over said cap including a container engaging means for attaching said closure to said container;

(d) an extending tab on said cap extending through a centrally located hole in the top of said closure;

(e) an alignment means for aligning said offset axis of said extending neck portion into a concentric relationship with said offset axis of said peripheral wall and;

(f) a grip locking means positioned on said cap and said closure to prevent said closure removal when said cap rotates out of alignment with said container.

2. The child proof container and safety closure as defined in claim 1 wherein said alignment means comprises an alignment lug on said extending neck portion and an annular slot in said peripheral wall of said cap.

3. The child proof container and safety closure as defined in claim 1 wherein said alignment means further includes an alignment lug positioned on an outwardly facing annular surface of said peripheral wall of said cap which cooperates with an annular slot positioned on an inwardly facing portion of said extending neck portion.

4. The child proof container and safety closure as defined in claim 1 wherein said alignment means further includes an annular slot having a shoulder engaging an alignment lug to hold said offset axis of said extending neck portion in alignment with said offset axis of said peripheral wall.

5. The child proof container and safety closure as defined in claim 1 wherein said grip locking means comprises an inside serrated surface of said closure which cooperates with an outside serrated surface of said cap.

6. The child proof container and safety closure as defined in claim 5 wherein said inside serrated surface of said closure and said outside serrated surface of said cap further comprise relatively small teeth which grip lock together to prevent said closure removal from said container.

7. The child proof container and safety closure as defined in claim 1 wherein said container, said closure and said cap are formed of a plastic material.

8. The child proof container and safety closure as defined in claim 1 wherein said container is formed of glass.

9. The child proof container and safety closure as defined in claim 1 wherein said container and said closure are formed of metal.

10. The child proof container and safety closure as defined in claim 1 wherein a sealing disc is provided in a flat surface inside said cap for sealing with a lip on said extended neck portion of said container.

11. The child proof container and safety closure as defined in claim 1 wherein said cap further includes a coin slot in said extending tab which requires use of a hand held coin to allow closure removal.

12. The child proof container and safety closure as defined in claim 1 wherein said peripheral wall of said cap further includes an inwardly facing annular surface having a continuous circumferential recess which cooperates with a plurality of circumferentially spaced lateral projecting beads which are positioned on an outwardly facing portion of said extending neck portion.

13. The child proof container and safety closure as defined in claim 1 wherein said safety closure and container engagement means comprises an external male thread on a neck portion of said container and an internal thread located inside a peripheral wall of said closure which cooperate in a threading engagement of said closure to said container.

* * * * *